US010221549B1

(12) United States Patent
Fregoe et al.

(10) Patent No.: US 10,221,549 B1
(45) Date of Patent: Mar. 5, 2019

(54) POP-UP DRAIN LINKAGE ASSEMBLY

(71) Applicant: Danco, Inc., Irving, TX (US)

(72) Inventors: Casey J. Fregoe, The Colony, TX (US); Robert Clifton Jones, Jr., Rockwall, TX (US)

(73) Assignee: Danco, Inc., Irving, TX (US)

( * ) Notice: Subject to any disclaimer, the term of this patent is extended or adjusted under 35 U.S.C. 154(b) by 0 days.

(21) Appl. No.: 15/917,144

(22) Filed: Mar. 9, 2018

(51) Int. Cl.
*E03C 1/23* (2006.01)

(52) U.S. Cl.
CPC ..... *E03C 1/2302* (2013.01); *E03C 1/2306* (2013.01)

(58) Field of Classification Search
CPC ..... E03C 1/23; E03C 1/2302; E03C 1/2306; E03C 2001/2317
See application file for complete search history.

(56) References Cited

U.S. PATENT DOCUMENTS 1,254,897 A * 1/1918 Frankenberger et al. ..... E03C 1/23 4/690
1,255,389 A * 2/1918 Cornelius ..... E03C 1/23 251/118
1,483,850 A * 2/1924 Kaufman ..... E03C 1/23 251/75
1,485,669 A * 3/1924 Davis ..... E03C 1/23 4/690
1,758,226 A * 5/1930 Kaufman ..... E03C 1/23 251/75
3,125,764 A * 3/1964 Young ..... E03C 1/23 24/115 R
4,192,026 A * 3/1980 Williams ..... E03C 1/23 4/673
2011/0185494 A1* 8/2011 Beck ..... E03C 1/23 4/689
2012/0060274 A1* 3/2012 Duncan ..... E03C 1/2302 4/679

* cited by examiner

*Primary Examiner* — Janie Loeppke
(74) *Attorney, Agent, or Firm* — Thomas Horstemeyer, LLP.

(57) ABSTRACT

Disclosed are various embodiments of a linkage assembly apparatus that comprise a spring clip that comprises a first end aperture, a second end aperture, and a connector aperture separated between a number of bending lines positioned along a length of the spring clip. The spring clip can be elastically deformed for insertion of a lift rod through the first end aperture and the second end aperture. The linkage assembly can also include an upper linkage rod that extends in a direction longitudinally. The upper linkage rod comprises a socket at a first end and a snap-on connector at a second end. In addition, the linkage assembly includes a lower linkage rod comprising a ball disposed toward an end of the lower linkage rod and a slot that extends along a length of the lower linkage rod. The slot can be used for connecting with a ball rod of a pop-up drain body.

20 Claims, 19 Drawing Sheets

POP-UP DRAIN LINKAGE ASSEMBLY

BACKGROUND

Linkage assemblies are used to connect a lavatory pop-up drain assembly to a lift rod of a bathroom faucet. When a lift rod is pulled up, the linkage assembly mechanically interacts with a drain assembly to pull a drain stopper down to plug a sink bowl. For an installation, a particular linkage assembly must be carefully selected to accommodate the dimensions of the sink bowl and the faucet.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1A:
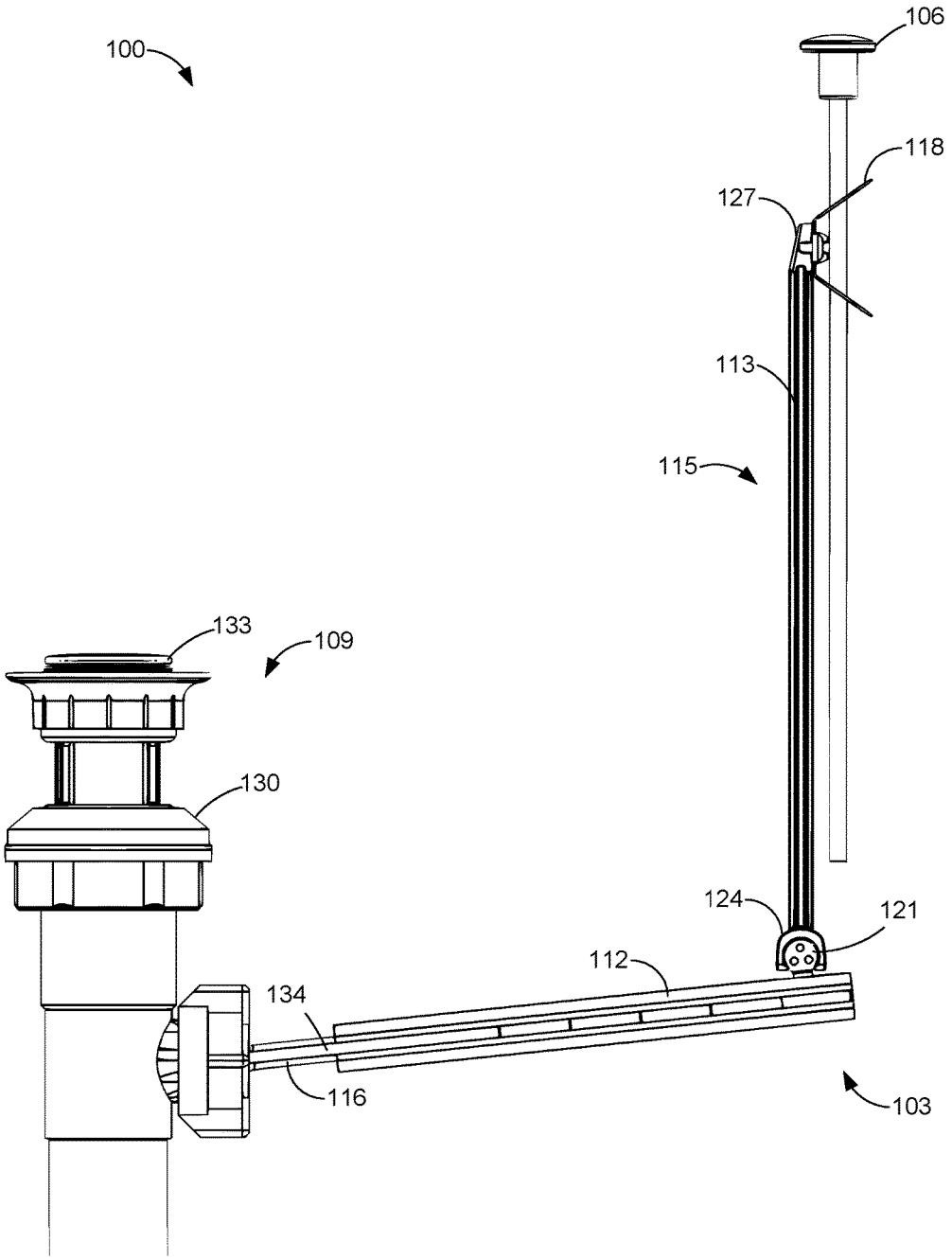
FIG. 1A is a side view of a lavatory pop-up drain linkage assembly 100, according to one embodiment described herein.

Oftentimes, linkage assemblies are used to connect a pop-up drain assembly to a lift rod of a faucet. When a lift rod is raised from the faucet, the linkage assembly mechanically causes a drain stopper to lower and plug the sink bowl. However, existing linkage assemblies have limited options for adjusting to the dimensions of a sink bowl and a drain assembly with respect to the faucet. For example, an upper linkage rod that connects to a lift rod may have limited adjustment settings because of the spacing of various apertures in existing linkage assemblies. In other words, an upper portion of existing linkage assemblies oftentimes has pre-cut apertures for adjusting the height of the connection to a lift rod. Accordingly, existing linkage assemblies have limited options for height adjustments because of the spacing of the pre-cut apertures.

The embodiments of the present disclosure relate to an improved linkage assembly for connecting a lavatory pop-up drain assembly to a lift rod of a faucet. The embodiments enable easier installation and provide for infinite adjustability within the range of a lift rod to accommodate different dimensions of bathroom sinks and faucets. For instance, bathroom sinks can vary with respect to a depth from the drain of the sink bowl to the faucet. The embodiments include a spring clip or a retaining clip for attaching the lift rod that enables infinite adjustability for sliding the lift rod to a desired height.

Additionally, the embodiments also provide greater retention strength between an upper portion of a linkage assembly and a lift rod. In other words, previous designs suffered from the lift rod detaching from a linkage assembly when a user pulled on the lift rod to plug the sink bowl. The spring clip enables greater retention strength for attaching the linkage assembly to the lift. The spring clip can be bent to insert an end of the lift rod through two apertures in the spring clip. Accordingly, there are infinite positions for the lift rod because the spring clip can be used to attach to the lift rod at any point along the length of the lift rod.

In addition, the embodiments comprise a ball and socket connection that provides a greater degree of rotational capability for different installation configurations and provides for additional packaging configurations. For example, in some scenarios, the ball and socket components can enable some embodiments to be pre-assembled and packaged in a smaller form factor than previous designs. For instance, when pre-assembled, a lower linkage rod and an upper linkage rod can be packaged adjacent to each other in a parallel configuration while connected by way of the ball and socket connection. Upon removing the linkage assembly from its packaging, the lower linkage rod and the upper linkage rod can be rotated about the ball and socket connection to position the rods in a substantially perpendicular configuration in preparation for installation. Accordingly, the various embodiments simplify the installation process and provide additional adjustment capabilities for a linkage assembly used to connect a lavatory pop-up drain assembly to a lift rod of a faucet.

Figure 1B:
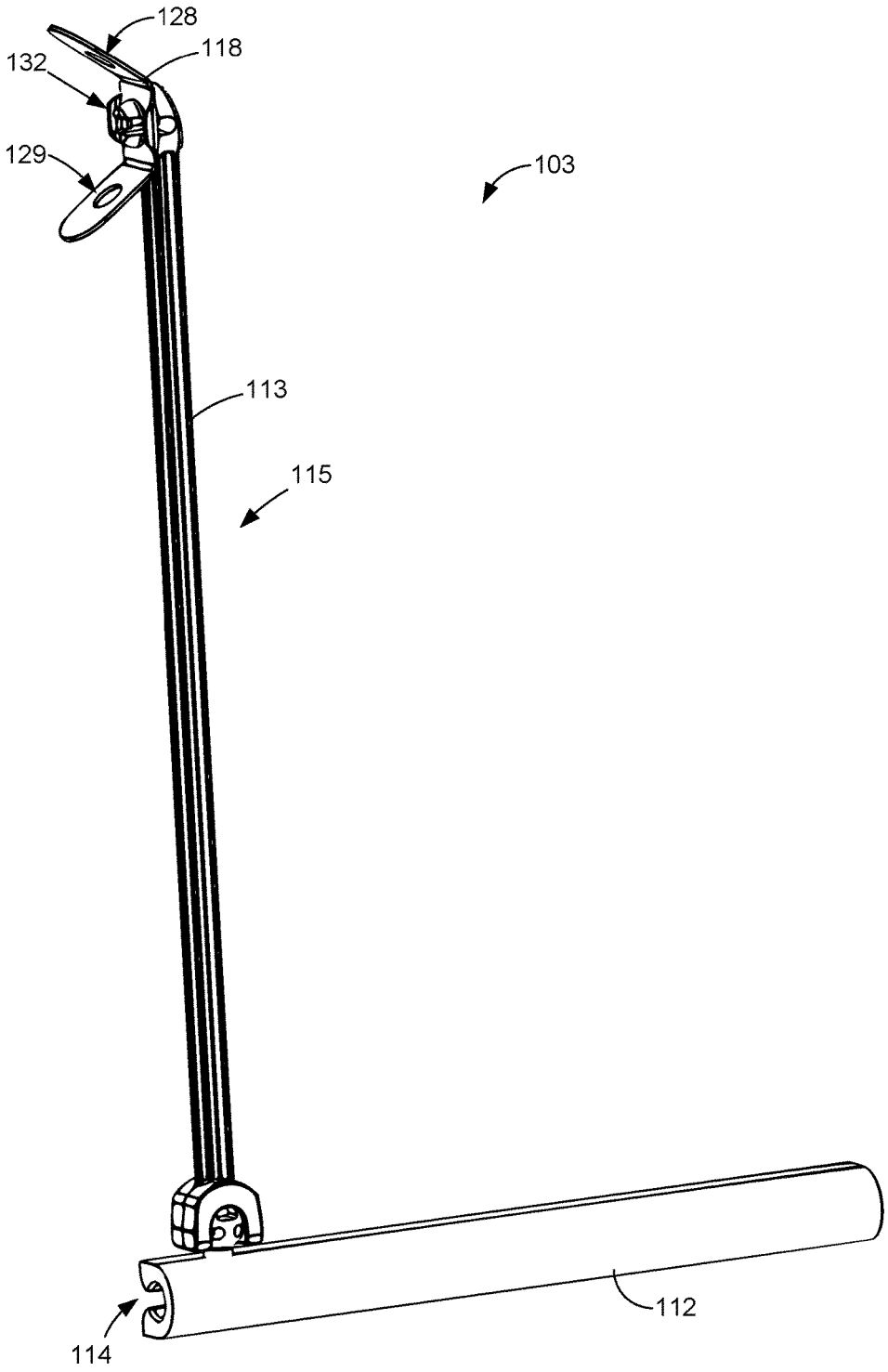
FIG. 1B illustrates a perspective view of the linkage assembly from FIG. 1A, according to one embodiment described herein.

With reference to FIG. 1A, a side view of a lavatory pop-up drain linkage assembly 100 is shown. The lavatory pop-up drain linkage assembly 100 comprises a linkage assembly 103, a lift rod 106, and a pop-up drain assembly 109. The linkage assembly 103 comprises a lower linkage rod 112, an upper linkage rod 115, and a spring clip 118. FIG. 1B illustrates a different angle of the linkage assembly 103 in FIG. 1A. The lower linkage rod 112 can be used for connecting to a ball rod 116 of the pop-up drain assembly 109. In some embodiments, the lower linkage rod 112 can be a clamp rod. The lower linkage rod 112 can comprise an elongated cylinder with a ball 121 that extends from an end of the lower linkage rod 112. The ball 121 can extend perpendicularly to a length of the lower linkage rod 112.

The lower linkage rod 112 can be comprised of soft polyvinyl chloride (PVC) or other suitable materials. In some embodiments, the ball 121 can be an overmolded component. For example, a shaft of the lower linkage rod 112 can be comprised of a first material, and the ball 121 can be comprised of a second material. Different materials may be used for different components for the lower linkage rod 112 in order to enable the different components to perform different functions. For example, the ball 121 can be comprised of polyoxymethylene (POM), also known as Acetal, or any other rigid plastic, as well as Brass, stainless steel or aluminum (anodized or powder coated) or other suitable materials. In some embodiments, the ball 121 may be comprised of a harder, smoother material, such as Acetal, in order to enable smoother rotation of the ball 121 within the socket. Additionally, Acetal can better withstand the friction being applied overtime in a ball and socket connection. The lower linkage rod 112 also comprises a slot 114 that can extend the entire length of the lower linkage rod 112. The slot 114 can also extend merely a portion of the length of the lower linkage rod 112. The slot 114 provides access to an interior of the lower linkage rod 112.

The upper linkage rod 115 can be used to connect the lower linkage rod 112 to the lift rod 106. The upper linkage rod 115 comprises a shaft 113 with a first end and a second end. The upper linkage rod 115 can extend in a longitudinal direction. The first end of the upper linkage rod 115 can have a socket 124, and the second end of the upper linkage rod 115 can have a snap-on connector 127. The upper linkage rod 115 can be comprised of Polycarbonate Acrylonitrile Butadiene Styrene (PC/ABS) or other suitable materials. In some embodiments, the upper linkage rod 115 can be a link rod. The ball 121 of the lower linkage rod 112 can be positioned within the socket 124 of the upper linkage rod 115. In some embodiments, the ball 121 is snapped into the socket 124 because of the expansion and contraction of the sides of the socket 124.

The snap-on connector 127 of the upper linkage rod 115 can be used to attach the spring clip 118 to the upper linkage rod 115. Additionally, the spring clip 118 can be used to attach the lift rod 106 to the linkage assembly 103. The spring clip 118 can be used to attach to the lift rod 106 at various points along the length of the lift rod 106. The spring clip 118 can be comprised of stainless steel or other suitable materials. The spring clip 118 comprises a first aperture 128 at a first end, a second aperture 129 at a second end, and a connector aperture 132 that is between the first aperture 128 and the second aperture 129.

The lift rod 106 can be a component of a faucet. The lift rod 106 can be inserted through a lift rod opening in the faucet. Thus, a top portion of the lift rod 106 can be accessible above a countertop as part of the faucet and a lower portion of the lift rod 106 can be attached to the linkage assembly 103 below on the countertop.

The pop-up drain assembly 109 comprises the ball rod 116, a drain body 130, and a drain stopper 133. The drain stopper 133 can move up and down out of a top opening in the drain body 130. The ball rod 116 can be used to attach the linkage assembly 103 to the drain body 130. The ball rod 116 can include a cylinder with a ball at one end and a raised edge 134 that extends along on a length of the ball rod 116. The ball rod 116 can be used to mechanically pull the drain stopper 133 down to plug the sink bowl. Specifically, when the lift rod 106 is the pulled up, the linkage assembly 103 can rotate the ball end of the ball rod 116 downward, and the ball end of the ball rod 116 can cause the drain stopper to be pulled down. Then, the lift rod 106 can be pushed downward, and this action can cause the linkage assembly 103 to rotate the ball end of the ball rod 116 upward. By rotating the ball end of the ball rod 116 upward, the drain stopper 133 can move up above the top opening of the drain body 130. In this state, water in the sink bowl can flow into the drain body 130 and later into a drain pipe.

Referring between FIG. 1A and FIG. 1B, a description of an assembly process of the linkage assembly 103 and the operation of the linkage assembly 103 is provided. With regard to assembling the linkage assembly 103, the ball 121 of the lower linkage rod 112 can be inserted into the socket 124 of the upper linkage rod 115. In some embodiments, the insertion may involve snapping the ball 121 into the socket 124 because of an expansion and contraction of the socket 124. Then, a portion of the snap-on connector 127 can be inserted through the connector aperture 132 of the spring clip 118 to attach the spring clip 118 to the upper linkage rod 115. The first aperture 128 at the first end and the second aperture 129 at the second end of the spring clip 118 can be moved toward each other by applying force at the first end and second end of the spring clip 118. Then, an end of the lift rod 106 can be inserted through the first aperture 128 and the second aperture 129. Next, the raised edge 134 of the ball rod 116 can be aligned with the slot 114 of the lower linkage rod 112. The cylindrical portion of the ball rod 116 can be inserted into the interior of the lower linkage rod 112. Once inserted, the raised edge 134 can be adjacent to the sides of the lower linkage rod 112 that form the slot 114. The raised edge 134 of the ball rod 116 can be restrained by the sides of the slot 114 formed in the lower linkage rod 112. Accordingly, the raised edge 134 can prevent the ball rod 116 from rotating within the interior of the lower linkage rod 112.

Once assembled, the upper linkage rod 115 can rotate about the ball 121 of the lower linkage rod 112. The rotational capability can enable the upper linkage rod 115 to be collapsed adjacent to the lower linkage rod 112. Further, this rotational capability enables for the linkage assembly 103 to be pre-assembled in a small form factor and enables for easier installation from previous implementations.

As a non-limiting example of its operation, the linkage assembly 103 can be used to connect the lift rod 106 and the pop-up drain assembly 109 in order to operate the drain stopper 133. For instance, the lift rod 106 can be raised upward away from the pop-up drain assembly 109 and cause the upper linkage rod 115 to move upward as well. This movement can raise the end of the lower linkage rod 112 with the ball 121, which in turn can cause the ball rod 116 to rotate its ball end downward. This downward rotation of the ball rod 116 can cause the drain body 130 to pull the drain stopper 133 down to plug the sink bowl, which can prevent water from draining out of the sink bowl.

Continuing with this example, when the lift rod 106 is pushed downward toward the pop-up drain assembly 109, the upper linkage rod 115 moves downward and causes the ball end of the ball rod 116 to rotate upward. The ball end of the ball rod 116 can cause the drain stopper 133 to move upward away from the drain body 130. Accordingly, the water in the sink bowl can flow into the drain body 130 and away to a drain pipe.

Figure 2A:
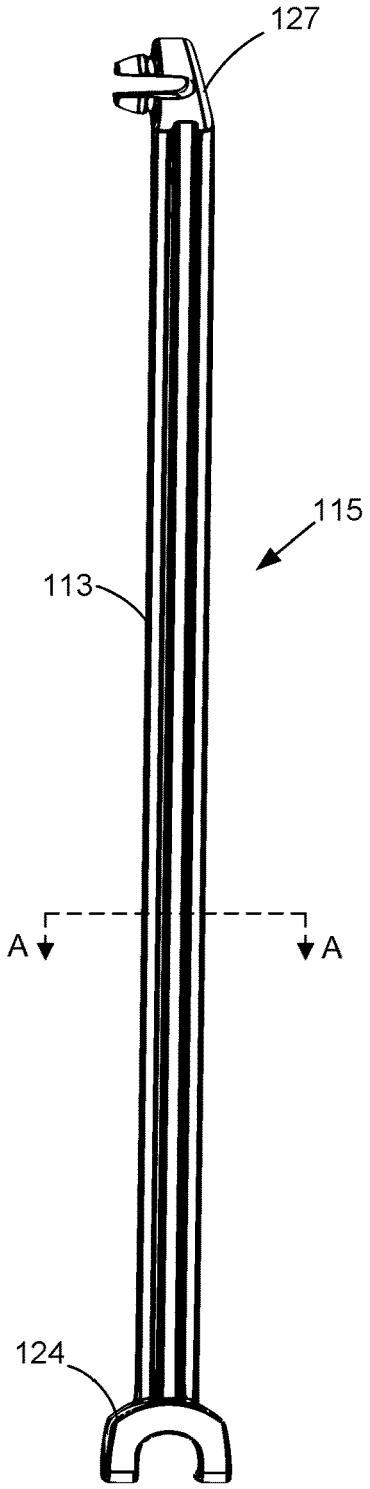
FIGS. 2A-2E illustrate different views of the upper linkage rod from FIG. 1A, according to one embodiment described herein.
Figure 2B:
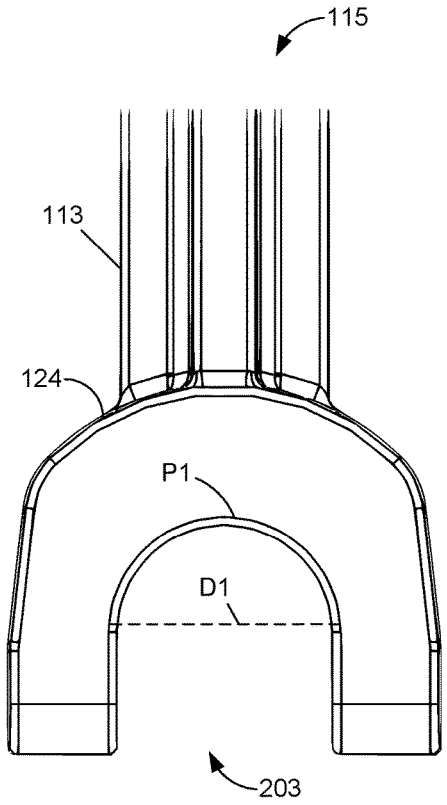
Figure 2C:
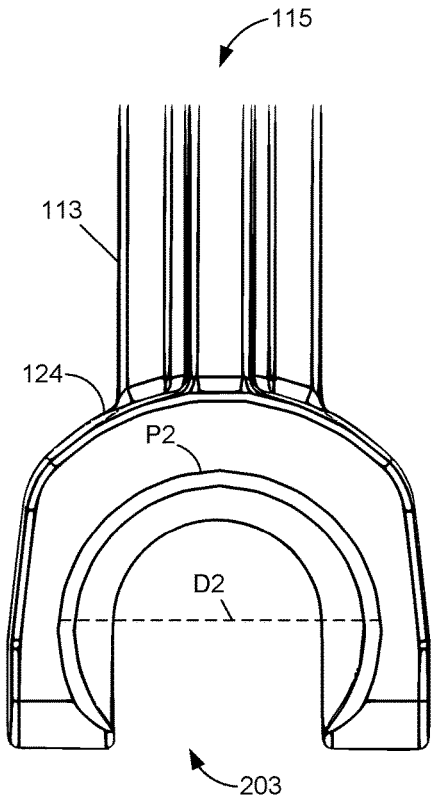

With reference to FIGS. 2A-2E, shown are various views of the upper linkage rod 115. In FIG. 2A, the upper linkage rod 115 comprises the snap-on connector 127 at a first end and the socket 124 at a second end. FIG. 2A also includes an "A-A" cross-sectional reference for FIG. 2E. FIGS. 2B and 2C illustrate enlarged views of the socket 124 at the second end of the upper linkage rod 115. Particularly, FIG. 2B illustrates an enlarged view of a first side of the socket 124 in FIG. 2A. FIG. 2C illustrates an enlarged view of a second side of the socket 124. The second side of the socket 124 is a 180 degree rotation of the upper linkage rod 115 from the first side.

FIG. 2B illustrates that a perimeter P1 of an opening 203 on the first side of the socket 124 comprises a U-shape. The U-shaped perimeter P1 comprises a diameter D1 across its widest point. In some embodiments, the U-shape perimeter P1 can enable greater rigidity for the ball and socket connection. FIG. 2C illustrates that a perimeter P2 of the opening 203 on the second side of the socket 124 comprises a circular shape. The circular shape of perimeter P2 comprises a diameter of D2. Diameter D2 of the second side is larger than diameter D1 of the first side. The ball 121 can enter the socket 124 by being inserted through the second side of the socket 124. Diameter D1 is also smaller than a diameter of the ball 121. Additionally, in some embodiments, the second side of the socket 124 in FIG. 2C can expand to enable the ball 121 to enter the socket 124 and then contract to retain the ball 121 within the socket 124. Particularly, the material composition and the circular shape of the socket 124 can enable the ball 121 to be snapped into the socket 124. Additionally, the ball 121 cannot pass through the first side of the socket 124. As one skilled in the art can appreciate, other shapes for the sides of the socket 124 can be used to enable the ball 121 to be inserted and retained within the socket 124.

Figure 2D:
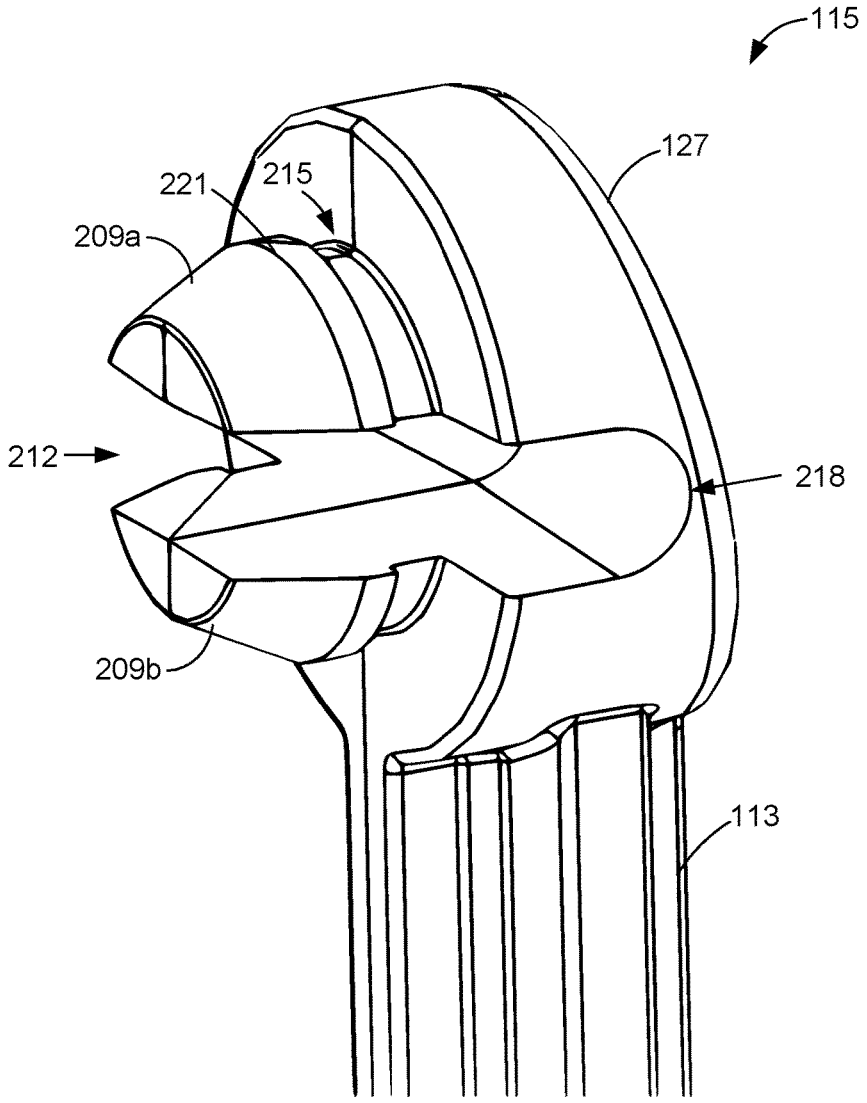

Moving to FIG. 2D, shown is a perspective view of the snap-on connector 127 from FIG. 2A. The snap-on connector 127 comprises a first lip 209*a* and a second lip 209*b* (collectively "lips 209") that are separated by a connector slot 212. In FIG. 2D, the connector slot 212 is formed from the first lip 209*a*, the second lip 209*b*, and a slot base 218. The connector slot 212 can enable the first lip 209*a* and the second lip 209*b* to move toward each other to enable the lips 209 to fit within the connector aperture 132 of the spring clip 118. In other words, the slot base 218 can bend to move the first lip 209*a* toward the second lip 209*b*. Additionally, the lips 209 and a base of the snap-on connector 127 form a circular slot 215 around the lips 209. Once the lips 209 are inserted through the connector aperture 132, the spring clip 118 can be positioned in the circular slot 215. The lips 209 comprise a raised edge 221 that keeps the spring clip 118 in the circular slot 215. The circular slot 215 can enable the spring clip 118 to rotate. This rotational feature can support a faucet configuration where the lift rod 106 may not be in the same plane as the linkage assembly 103. In other words, the upper linkage rod 115 and the lower linkage rod 112 can be a different plane from the lift rod 106 because the spring clip 118 can rotate to accommodate an offset alignment of the upper linkage rod 115 and the lower linkage rod 112 with respect to the lift rod 106.

Figure 2E:
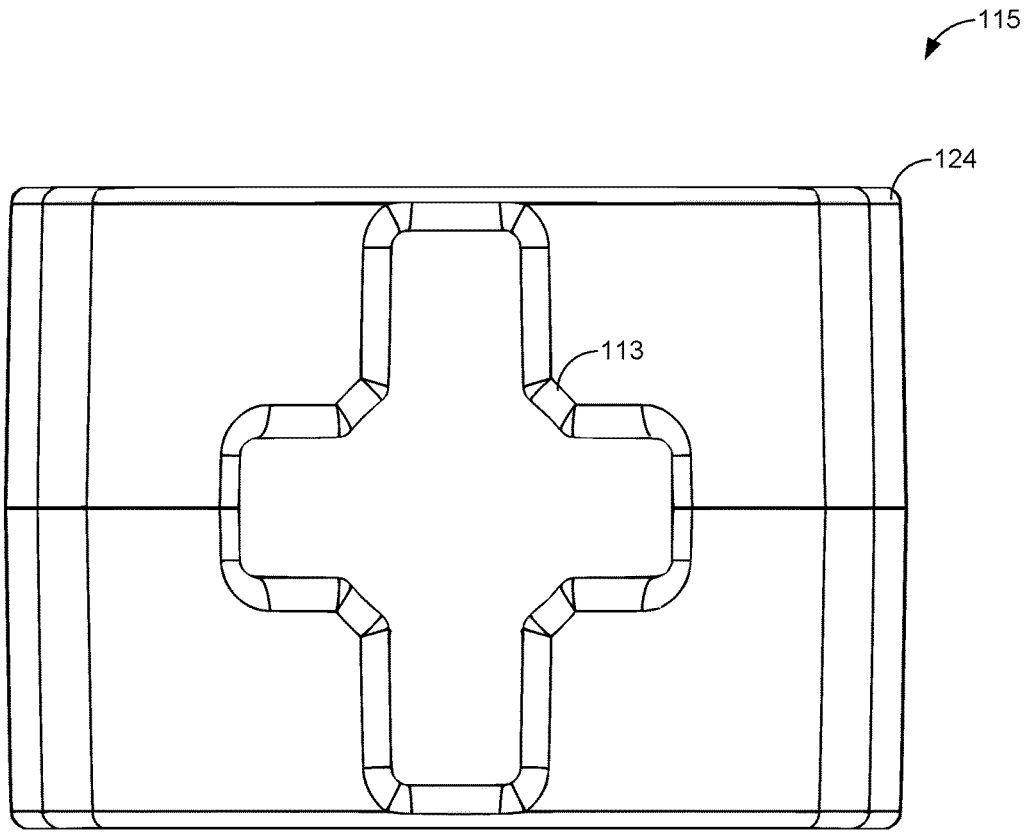

Turning to FIG. 2E, shown is a cross-sectional view of the upper linkage rod 115. Specifically, FIG. 2E is a cross-sectional view for the "A-A" cross-sectional reference in FIG. 2A. In the illustrated embodiment, FIG. 2E depicts the shaft 113 as comprising a cross shape. In other embodiments, the shaft 113 can be considered as having four elongated rectangular ribs that are perpendicular to each other. This illustrated structure of the shaft 113 provides greater rigidity for the upper linkage rod 115.

Figure 3A:
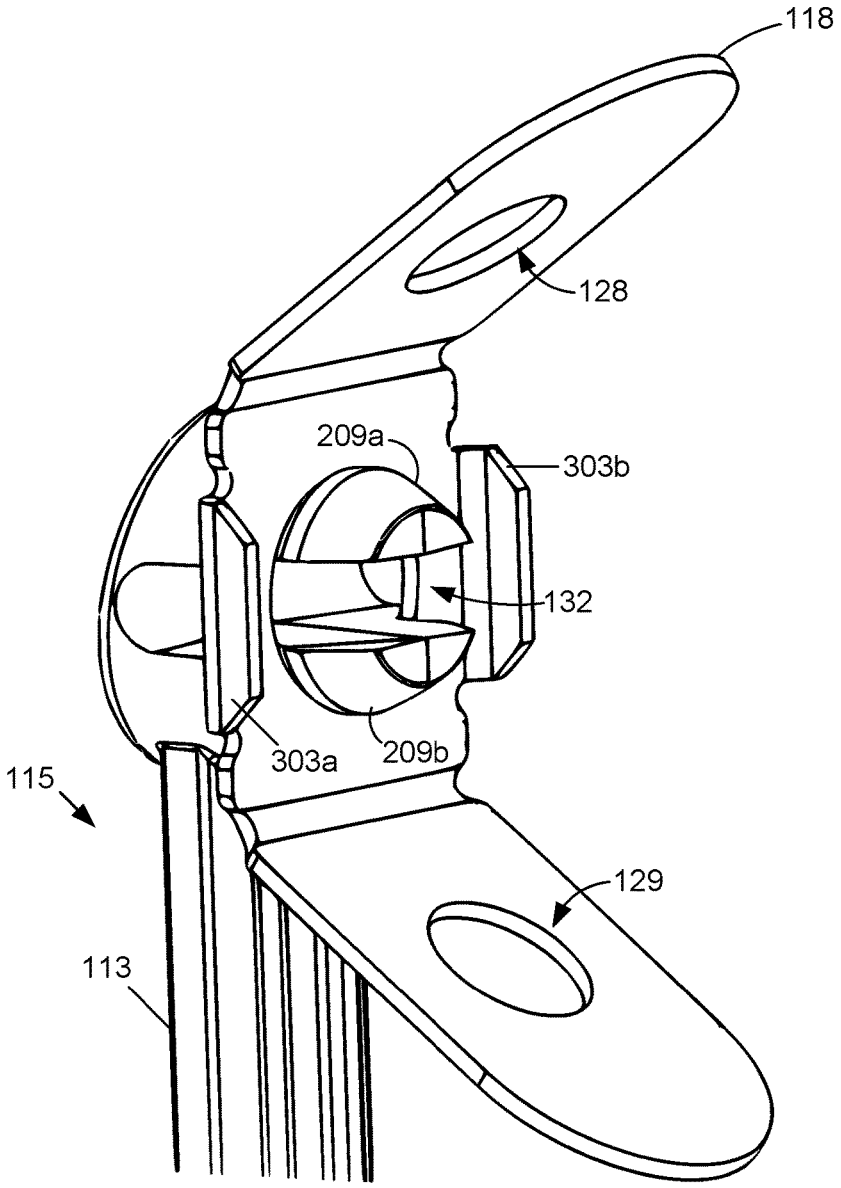
FIG. 3A illustrates a perspective view of the snap-on connector of the upper linkage rod and the spring clip from FIG. 1A, according to one embodiment described herein.

With reference to FIG. 3A, shown is a perspective view of the snap-on connector 127 and the spring clip 118. FIG. 3A illustrates the connector aperture 132 of the spring clip 118 being positioned around the circular slot 215 (FIG. 2D). Additionally, FIG. 3A illustrates that the spring clip 118 comprises a first raised edge 303*a* and a second raised edge 303*b*.

As previously described, the first aperture 128 and the second aperture 129 can be moved toward each other by moving the first end and the second end of the spring clip 118 toward each other. In some exemplary implementations, the first end and the second end of the spring clip 118 can be moved to such a degree to align the first aperture 128 and the second aperture 129. When the first aperture 128 and the second aperture 129 are aligned, then an end of the lift rod 106 can be inserted through the first aperture 128 and the second aperture 129. As a person releases the pressure to squeeze the first aperture 128 and the second aperture 129 together, the first end and the second end can expand away from each other. This expansion can cause the first end and the second end of the spring clip 118 to press against the lift rod 106 at two points.

Figure 3B:
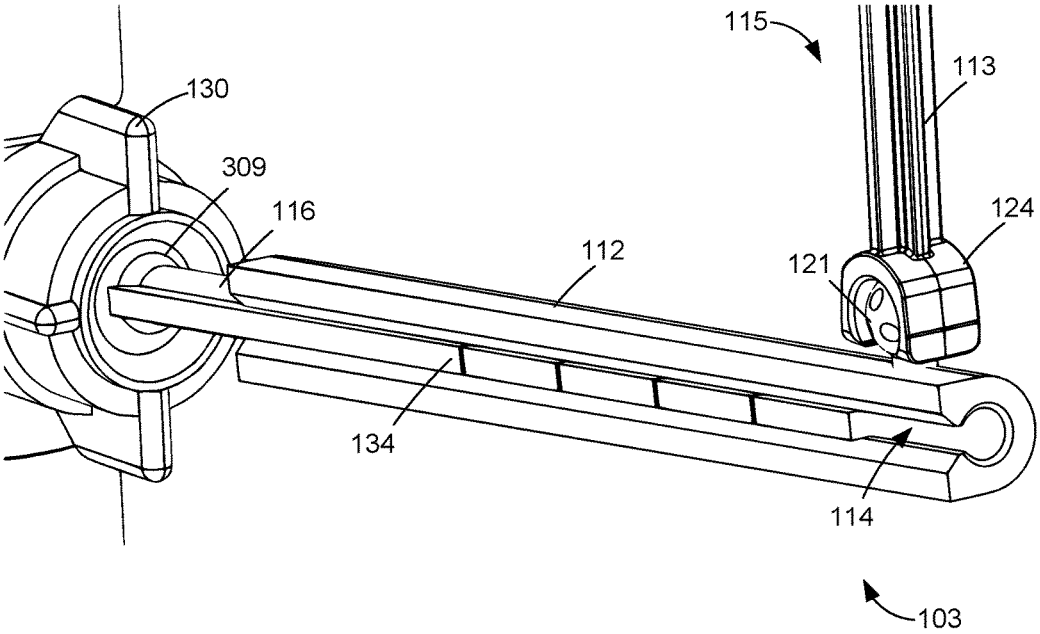
FIG. 3B illustrates a perspective view of the linkage assembly attached to the drain body from FIG. 1A, according to one embodiment described herein.

Turning to FIG. 3B, shown is a perspective view of the linkage assembly 103 being attached to the drain body 130. Particularly, FIG. 3B illustrates that the ball 121 can be positioned within the socket 124 of the upper linkage rod 115. In some embodiments, the ball 121 can be an over-molded component. In other words, the ball 121 can be comprised of a first material and the lower linkage rod 112 can be comprised of a second material. For example, the lower linkage rod 112 can be comprised of soft PVC or other suitable materials. The ball 121 can be comprised of Acetal or other suitable materials. Additionally, the ball end 309 of the ball rod 116 is positioned within the drain body 130 to mechanically move the drain stopper 133 up and down. FIG. 3B also illustrates that the raised edge 134 of the ball rod 116 is inserted into the slot 114 of the lower linkage rod 112. The raised edge 134 can prevent the ball rod 116 from rotating within the interior of the lower linkage rod 112 because the raised edge 134 is restricted by the sides of the lower linkage rod 112 that form the slot 114.

Next, FIGS. 3C through 3I refer to alternative methods for attaching the spring clip 118 to an end of the upper linkage rod 115. Particularly, FIGS. 3C through 3I illustrate alternative connector heads for the upper linkage rod 115. Although the socket 124 is not shown, it is attached to other end of the upper linkage rods 115 illustrated in FIGS. 3C through 3I.

Figure 3D:
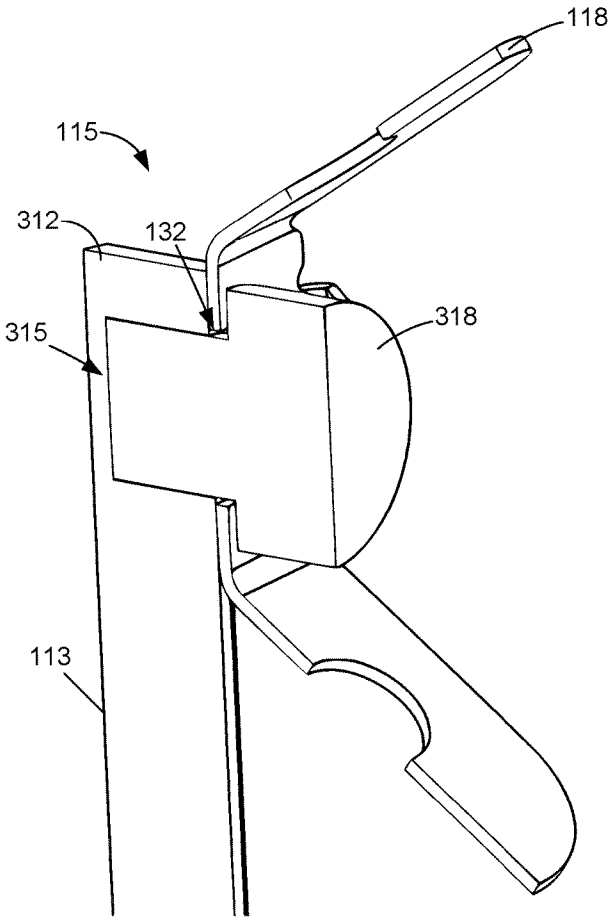
FIGS. 3C-3I illustrate various views of alternative fasteners for attaching the spring clip to the upper linkage rod, according to one embodiment described herein.
Figure 3C:
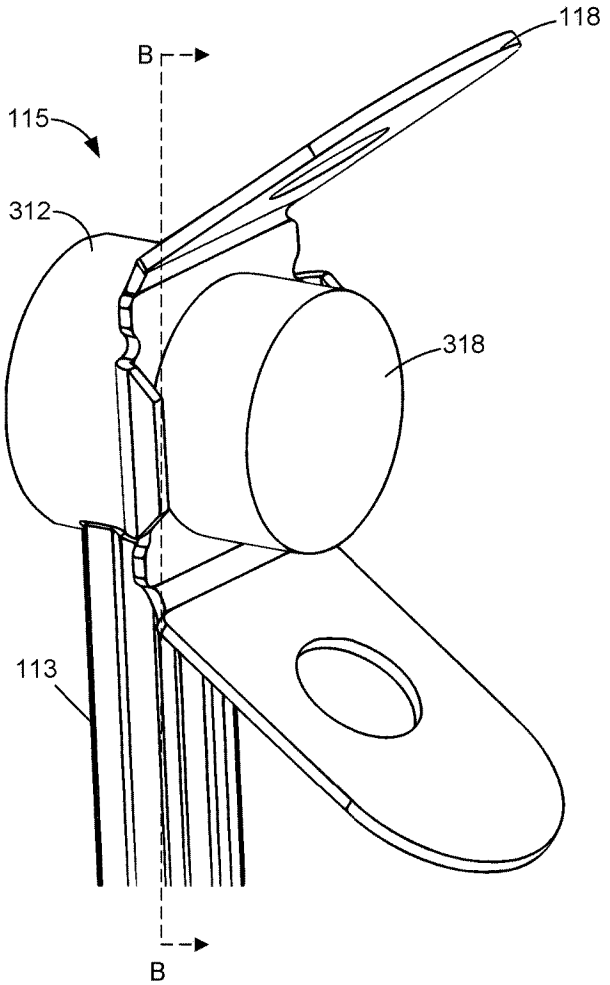

FIGS. 3C and 3D illustrate a bonded attachment method for the spring clip 118 and a connector head 312. FIG. 3C also includes a "B-B" cross sectional reference for the cross-sectional view in FIG. 3D. FIG. 3D illustrates that the connector head 312 includes a plug aperture 315 for receiving a plug 318. In some embodiments, the spring clip 118 can be attached by applying glue, epoxy, or some other suitable adhesive to the interior of the plug aperture 315 and/or to the plug 318. Then, the connector aperture 132 of the spring clip 118 can be aligned with the plug aperture 315 of the connector head 312. Then, the plug 318 can be inserted through the connector aperture 132 and into the plug aperture 315. The plug 318 can be inserted into the plug aperture 315 in such a way to provide sufficient clearance for the spring clip 118 to rotate about the plug 318.

Figure 3E:
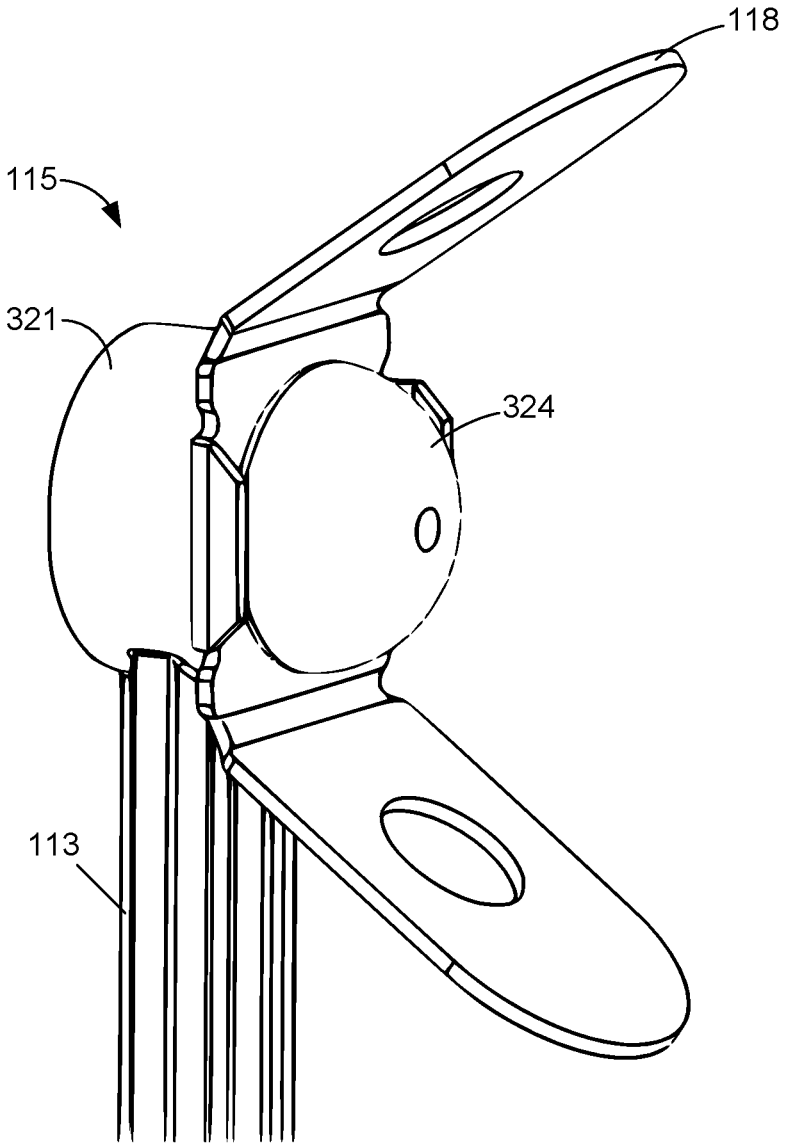

FIG. 3E illustrates a rivet attachment method for the spring clip 118 and a connector head 321. The connector head 321 has an aperture that is used for receiving a rivet 324. The aperture can extend completely through the connector head 321. The rivet 324 can comprise a smooth cylindrical shaft on a first end and a head on a second end. The head of the rivet 324 is illustrated in FIG. 3E and comprises a diameter that is larger than the aperture of the connector head 321. In some embodiments, the first end of the cylindrical shaft can be inserted and extended through the aperture of the connector head 321. Then, a portion of the rivet 324 extending through the back side of the connector head 321 can be deformed to expand the diameter of the first end of the rivet 324. In other words, the end of the smooth cylindrical shaft can be expanded to a diameter larger than the aperture of the connector head 321. Thus, the rivet 324 can be held in place by the deformed end of the rivet 324 on one side and the head of the rivet 324 on the other side.

Figure 3G:
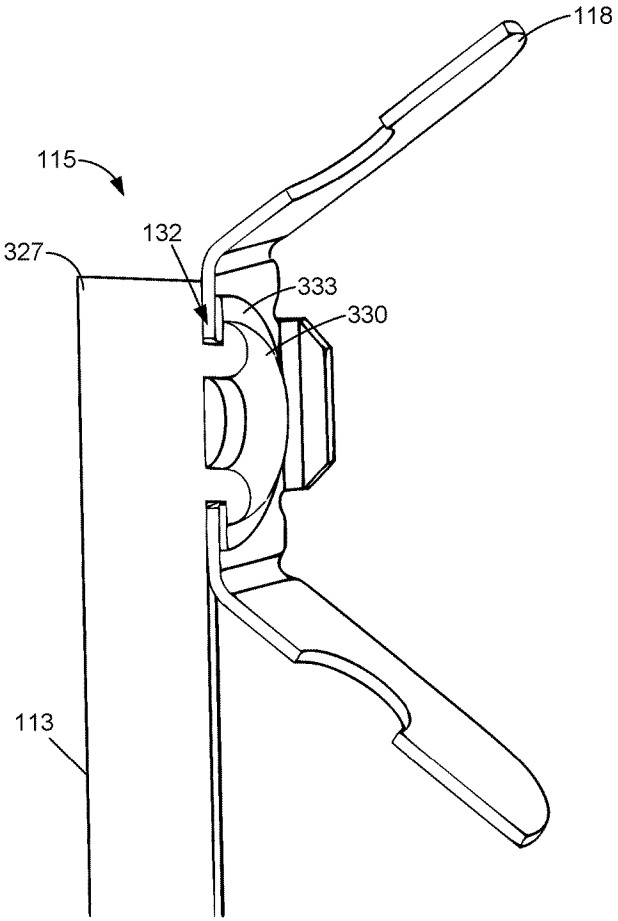
Figure 3F:
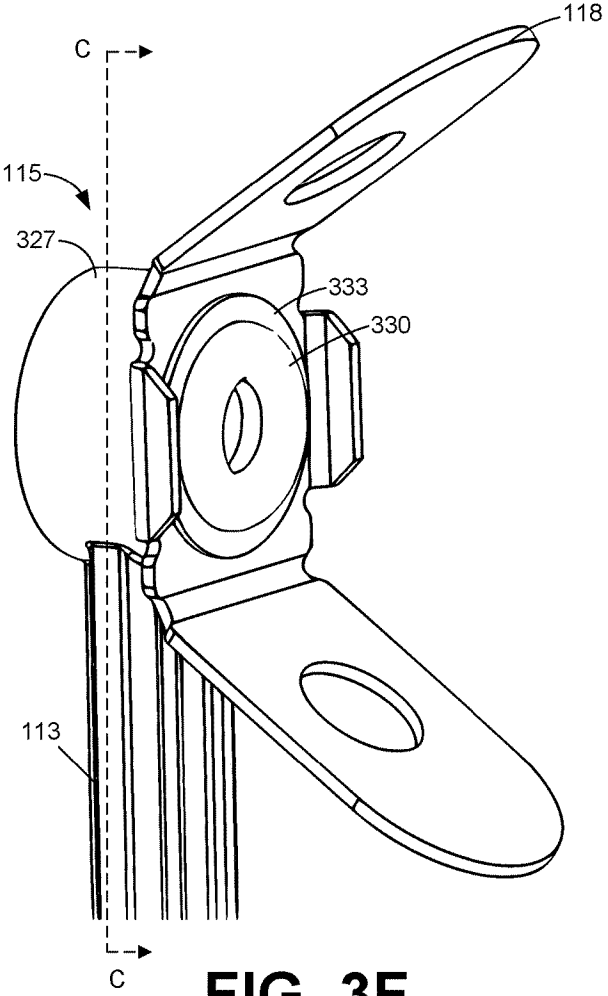

FIGS. 3F and 3G illustrate a first heat staked attachment method that uses an anti-friction washer for retaining the spring clip 118 with a first heat-staking head 327. FIG. 3F also includes a "C-C" cross-sectional reference for FIG. 3G. The first heat-staking head 327 can comprise a first stud 330 that extends from a base of the first heat-staking head 327. Initially, the first stud 330 can comprise a diameter that is less than an interior aperture diameter of a washer 333 and an interior aperture diameter of the connector aperture 132 of the spring clip 118. For example, the first stud 330 can be shaped as a cylinder extending from the first heat-staking head 327.

For attaching the spring clip 118, the first stud 330 can be inserted through the connector aperture 132 of the spring clip 118 and the interior aperture of the washer 333. The first stud 330 can be deformed to expand its diameter to be larger than the interior aperture diameter of the washer and the interior aperture diameter of the connector aperture 132, as depicted in FIGS. 3F and 3G. Thus, the first stud 330 can retain the washer 333 and the spring clip 118 in a deformed state because of its larger diameter. The washer 333 can provide a smooth surface that helps facilitate a rotation of the spring clip 118 about a shaft of the first stud 330. The first stud 330 can be deformed by a heat staking process that involves heating and shaping the material of the first stud 330 in order for the first stud 330 to retain the washer 333 and the spring clip 118.

Figure 3I:
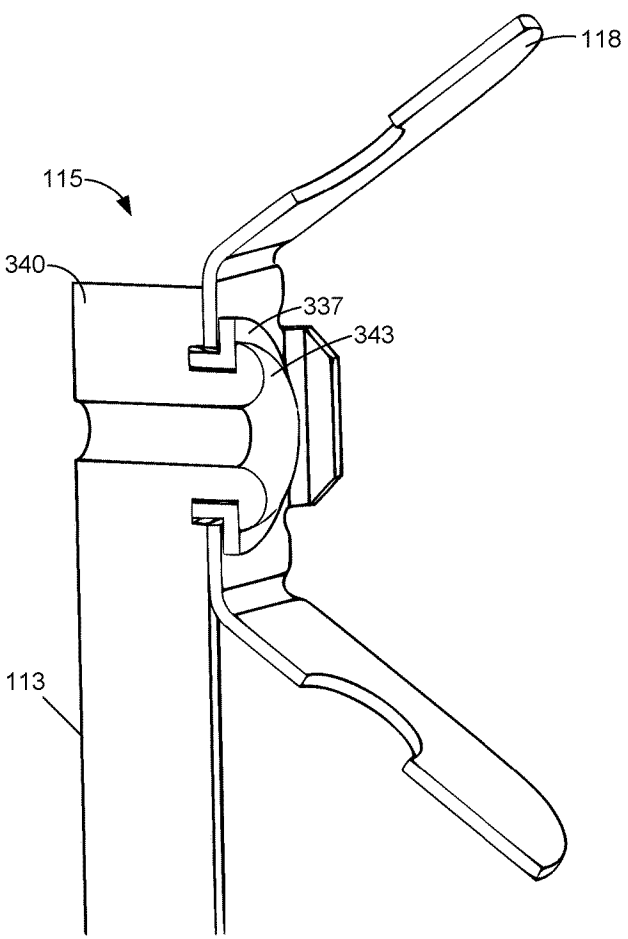
Figure 3H:
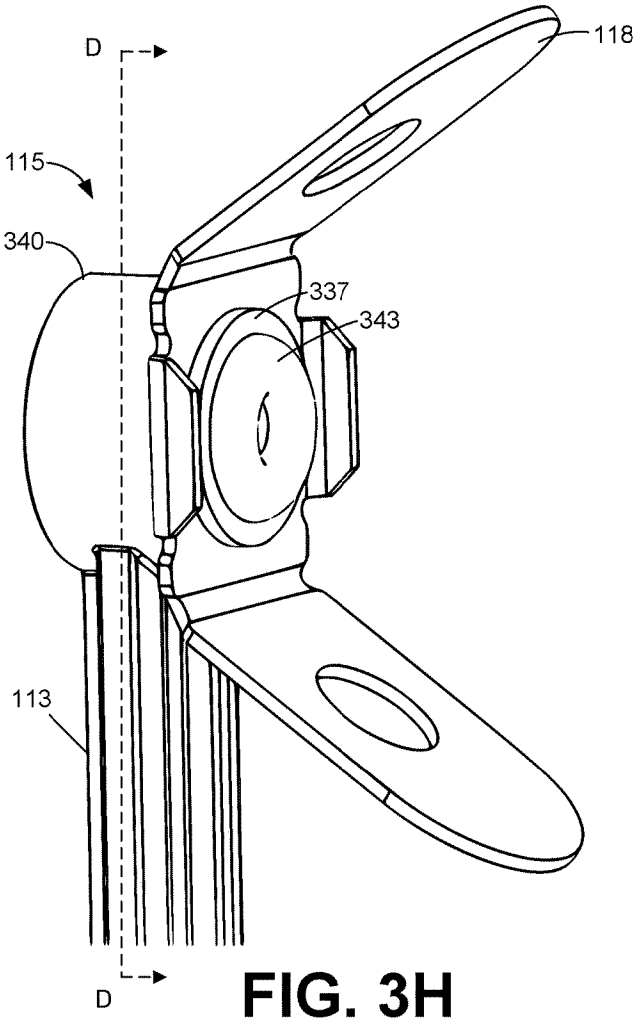

Likewise, FIGS. 3H and 3I illustrate a second heat staked attachment method that uses a ferrule 337 for retaining the spring clip 118 with a second heat-staking head 340. FIG. 3H also includes a "D-D" cross-sectional reference for the cross-sectional view in FIG. 3I. The second heat-staking head 340 can comprise a second stud 343 that extends from a base of the second heat-staking head 340. Initially, the second stud 343 can comprise a diameter that is less than an interior aperture diameter of a ferrule 337 and an interior aperture diameter of the connector aperture 132 of the spring clip 118. For example, the second stud 343 can have a cylindrical shape extending from the second heat-staking head 340. Additionally, the ferrule 337 comprises a cylindrical portion at a first end that has an outer diameter that is less than the interior aperture diameter of the connector aperture 132 of the spring clip 118. The ferrule 337 also includes a rim at a second end that has an outer diameter that is more than the interior aperture diameter of the connector aperture 132.

For attaching the spring clip 118, the cylindrical portion of the ferrule 337 can be inserted through the connector aperture 132 of the spring clip 118. The second stud 343 can be inserted through the interior aperture of the ferrule 337 with a portion of the second stud 343 extending past the rim of the ferrule 337. The portion of the second stud 343 extending past the rim can be deformed to expand its diameter to be larger than the interior aperture diameter of the ferrule 337. In a deformed state, the second stud 343 can retain the ferrule 337 and the spring clip 118. The rim of the ferrule 337 can provide a smooth surface that helps facilitate a rotation of the spring clip 118 about a portion the cylindrical portion of the ferrule 337 that was not deformed. The second stud 343 can be deformed by a heat staking process that involves heating and shaping the material of the second stud 343 in order for the second stud 343 to retain the ferrule 337 and the spring clip 118. Other fasteners can be used to secure the spring clip 118 to the upper linkage rod 115. Some non-limiting examples include screws, nuts and bolts, push-in fasteners, permanent push-in blind rivets, expanding shanks, ribbed shanks, Christmas tree fasteners, push-to-connect automotive fasteners, and other suitable fasteners.

Figure 4:
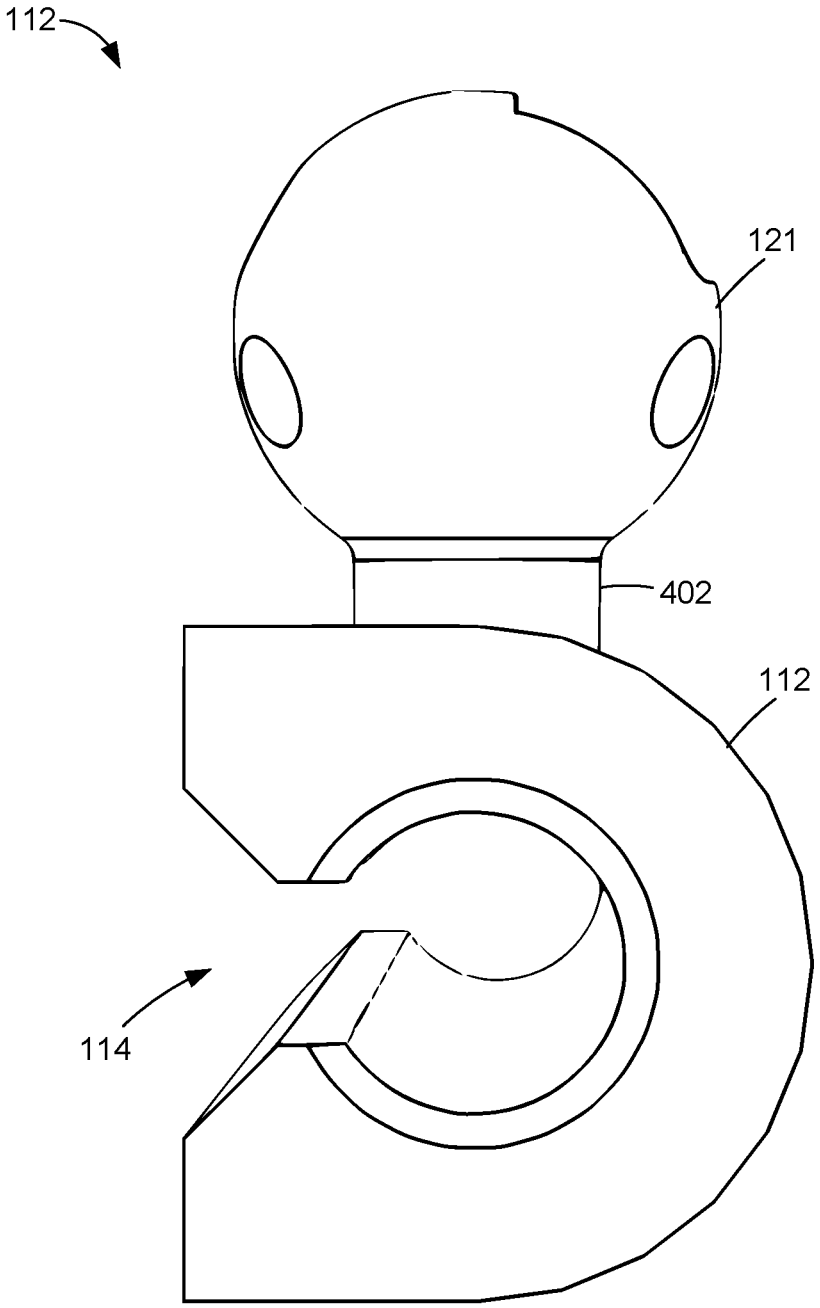
FIG. 4 illustrates a side view of the lower linkage rod from FIG. 1A, according to one embodiment described herein.

Moving to FIG. 4, shown is a side view of the lower linkage rod 112. In this embodiment, FIG. 4 illustrates that the lower linkage rod 112 has a slot 114 that extends the entire length of the lower linkage rod 112. From the outer surface of the lower linkage rod 112, a stand 402 extends and connects to the ball 121. In one embodiment, the ball 121 comprises various recessed areas to facilitate the molding process.

Figure 5A:
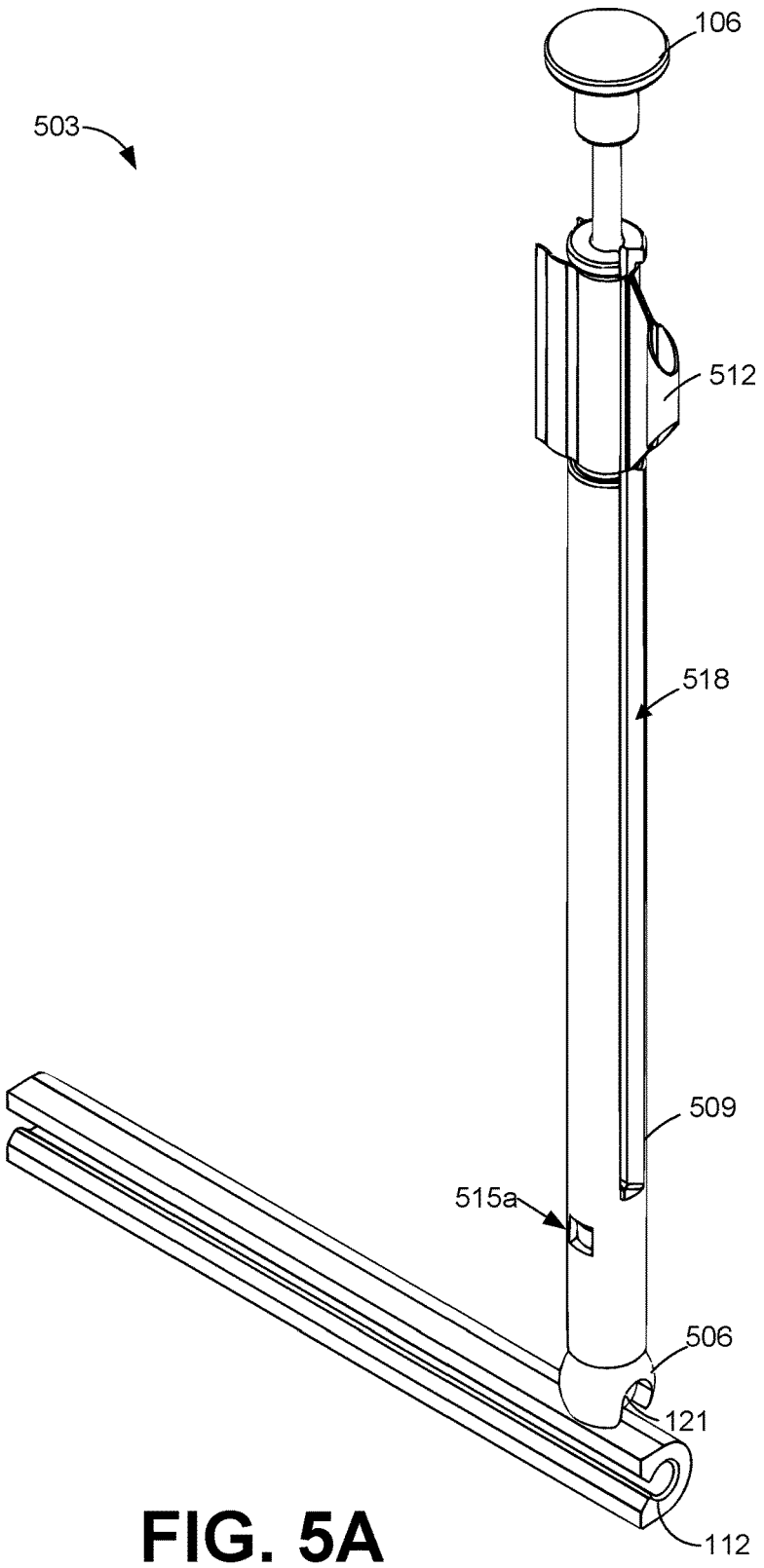
FIGS. 5A-5F illustrate various views of a flexible linkage assembly, according to one embodiment described herein.

Turning to FIG. 5A, shown is a perspective view of a flexible linkage assembly 503. The flexible linkage assembly 503 includes the lower linkage rod 112, the lift rod 106, a linkage socket 506, a flexible upper linkage rod 509, and a retaining clip 512. Particularly, the lower linkage rod 112 and the lift rod 106 can be similar to the corresponding components depicted in FIGS. 1A and 1B.

The flexible upper linkage rod 509 can be used to connect the lower linkage rod 112 with the lift rod 106. In this embodiment, the flexible upper linkage rod 509 can be connected with the linkage socket 506, which can be used to retain and rotate about the ball 121 of the lower linkage rod. The flexible upper linkage rod 509 can use the retaining clip 512 to squeeze a portion of the flexible upper linkage rod 509 radially inward against the lift rod 106. This radially inward force applied by the retaining clip 512 can serve as a mechanism for securing the lift rod 106 at a desired position. In this embodiment, the lift rod 106 can be infinitely adjustable with its range by sliding the lift rod 106 to a desired position and using the retaining clip 512 to secure the lift rod 106 at the desired position.

Figure 5B:
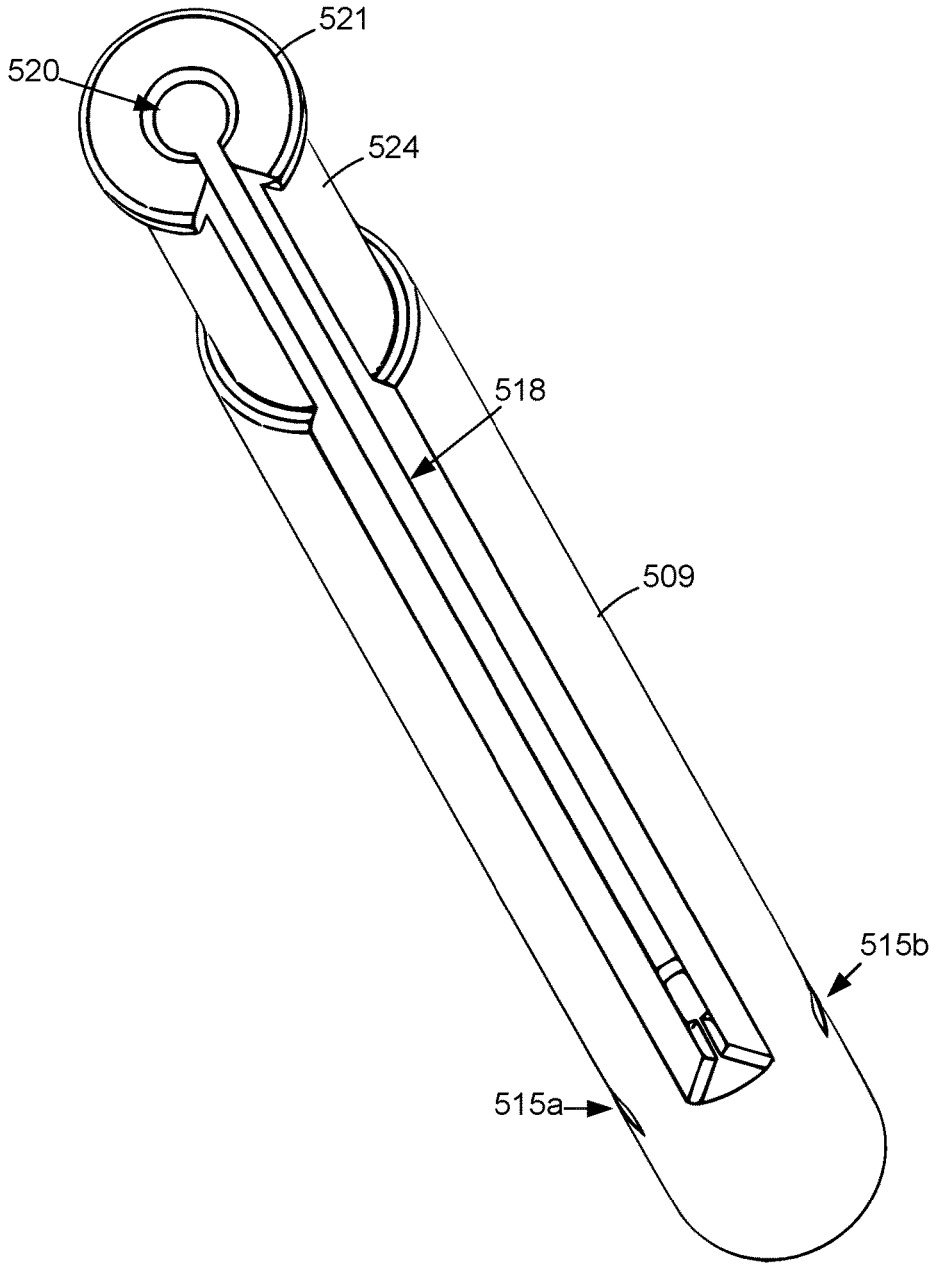

As illustrated in FIGS. 5A and 5B, the flexible upper linkage rod 509 can be an elongated cylinder that includes a first tab aperture 515*a* and a second tab aperture 515*b* (collectively "tab apertures 515") proximate to a first end. The flexible upper linkage rod 509 can be comprised of a flexible soft polyvinyl chloride (PVC) or other suitable flexible materials. Accordingly, the flexible upper linkage rod 509 can flex or distort its cylindrical shape. For example, the first end of the flexible upper linkage rod 509 can be distorted in order to insert the linkage socket 506. As another example, a second end of the flexible upper linkage rod 509 can be squeezed radially inward against the lift rod 106 to retain it as a desired position. The flexible upper linkage rod 509 includes a linkage slot 518 that extends along a portion of its length from the second end of the flexible upper linkage rod 509. The linkage slot 518 can facilitate the retention of the lift rod 106 because it enables the second end of the flexible upper linkage rod 509 to contract to a smaller diameter than if the linkage slot 518 were omitted.

The linkage socket 506 can be used to retain and rotate about the ball 121 of the lower linkage rod 112. The linkage socket 506 can be inserted into the first end of the flexible upper linkage rod 509. The insertion of the linkage socket 506 distorts the shape of the flexible upper linkage rod 509 at the first end because of the size of the linkage socket 506. Further, the insertion of the linkage socket 506 involves aligning aspects of the linkage socket 506 to snap in place with the first tab aperture 515*a* and a second tab aperture 515*b*.

The retaining clip 512 can be used as a mechanism for securing the lift rod 106 to a desired height. The retaining clip 512 comprises two sides that each have multiple arcuate portions. The sides of the retaining clip 512 can elastically deform in order to expand and contract an opening of the retaining clip 512. The retaining clip 512 can be comprised of stainless steel or other suitable materials. In one embodiment, the retaining clip 512 can be made by a progressive stamping process. With regard to installation, the lift rod 106 can be moved up or down within the interior of the flexible upper linkage rod 509. Then, the retaining clip 512 can be positioned to substantially wrap around a portion of the second end of the flexible upper linkage rod 509. The retaining clip 512 can be elastically deformed to increase a width of the opening of the retaining clip 512. Once opened, the retaining clip 512 can be inserted around the second end of the flexible upper linkage rod 509. As illustrated in FIG. 5A, the retaining clip 512 is positioned in a locked configuration. In this configuration, the lift rod 106 is secured to the flexible linkage assembly 503 and can be used to operate a drain stopper.

Moving to FIG. 5B, shown is a perspective view of the flexible upper linkage rod 509. As previously described, the flexible upper linkage rod 509 comprises an elongated cylinder with a first end and a second end. The first end of the flexible upper linkage rod 509 comprises the first tab aperture 515*a* and the second tab aperture 515*b* (collectively "tab apertures 515"). The tab apertures 515 can provide openings for receiving portions of the linkage socket 506 (FIG. 5A) in order to snap in place. At the second end, the flexible upper linkage rod 509 comprises an opening 520, a rim 521 and adjacent to the rim 521 is a recessed retaining slot 524. As illustrated in FIG. 5B, the recessed retaining slot 524 is a recessed area used to receive the retaining clip 512. FIG. 5B also depicts that the linkage slot 518 extends from the second end of the flexible upper linkage rod 509. The linkage slot 518 provides access to an interior of the flexible upper linkage rod 509. As illustrated in FIG. 5B, the linkage slot 518 is formed by a separation from a first side wall and a second side wall. The distance between the two side walls can be considered as a width of the linkage slot 518.

When the retaining clip 512 is positioned on the recessed retaining slot 524, the width of the linkage slot 518 can contract because of the force applied by the retaining clip 512. The decreased width of the linkage slot 518 decreases the amount of space in the interior of the flexible upper linkage rod 509 and ultimately reduces the interior diameter of the flexible upper linkage rod 509. Thus, the force applied by the retaining clip 512 can facilitate securing the lift rod 106 to the flexible upper linkage rod 509. Once the retaining clip 512 is removed, the width of the linkage slot 518 expands, which also expands the amount of space in the interior of the flexible upper linkage rod 509. Thus, the lift rod 106 can be released or adjusted to a new position.

Figure 5D:
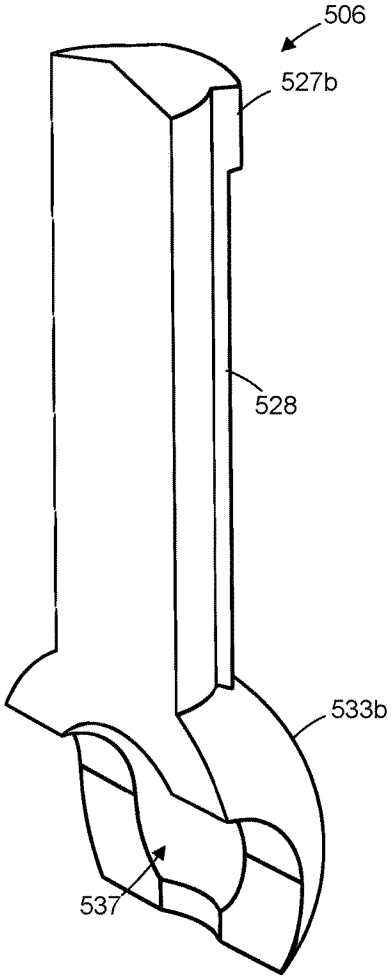
Figure 5C:
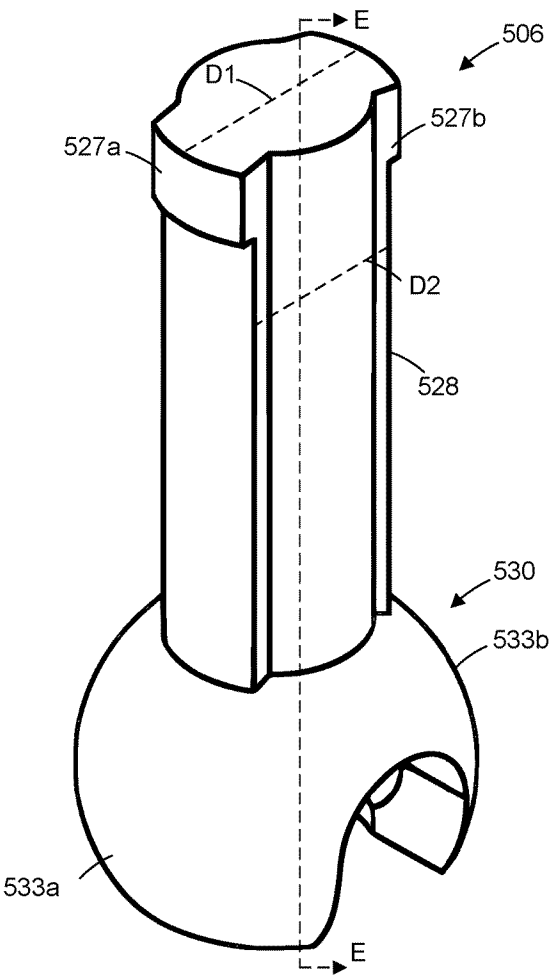

Turning to FIG. 5C, shown is a perspective view of the linkage socket 506. FIG. 5C also includes an "E-E" cross-sectional reference for the cross-sectional view illustrated in FIG. 5D. The linkage socket 506 comprises a first tab 527*a* and a second tab 527*b* (collectively "tabs 527") at a first end and a flexible socket 530 at a second end. The linkage socket 506 also comprises a socket shaft 528 that connects to the tabs 527 and the flexible socket 530. The diameter D1 can represent a distance from the first tab 527*a* to the second tab 527*b*. The diameter D2 can represent the longest distance from one side of the socket shaft 528 to other side. Diameter D1 can be larger than diameter D2. Additionally, diameter D2 can be smaller than an interior diameter of the flexible upper linkage rod 509, and diameter D1 can be larger than the interior diameter of the flexible upper linkage rod 509.

The flexible socket 530 comprises a first side 533*a* and a second side 533*b*. As illustrated in FIGS. 5C and 5D, the flexible socket 530 has a circular outer surface. FIG. 5D also illustrates that the flexible socket 530 has a circular recessed area 537 in the interior of the flexible socket 530. The ball 121 of the lower linkage rod 112 can be positioned in the circular recessed area 537.

Figure 5E:
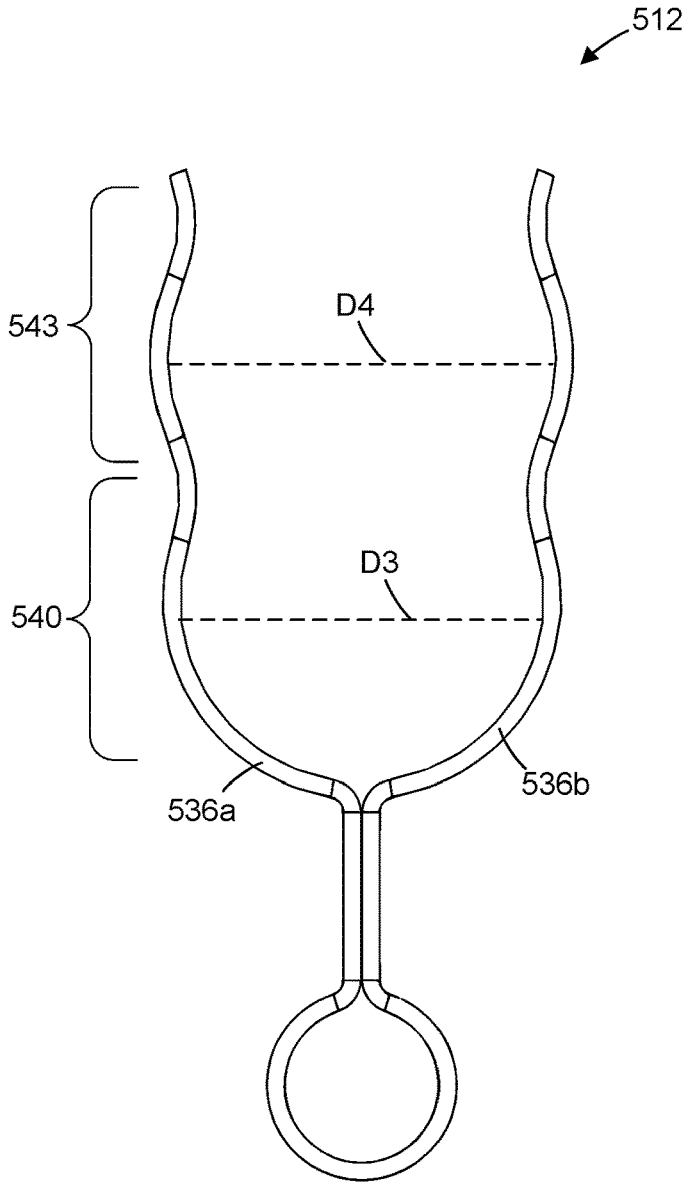

Moving to FIG. 5E, shown is a top view of the retaining clip 512. In some embodiments, the retaining clip 512 can be configured to have a first side 536*a* and a second side 536*b*. The first side 536*a* and the second side 536*b* can each have multiple arcuate portions. The first side 536*a* and the second side 536*b* can elastically deform in order to expand and contract an opening of the retaining clip 512. FIG. 5E illustrates a location for placing the flexible upper linkage rod 509 in a locked position 540 and a location for placing the flexible upper linkage rod 509 in an installed position 543. The locked position 540 has a diameter D3 that represents a distance between the first side 536*a* and the second side 536*b* at a particular position for attaching to the flexible upper linkage rod 509. The installed position 543 has a diameter D4 that represents a distance between the first side 536*a* and the second side 536*b* at a particular position for attaching to the flexible upper linkage rod 509. Diameter D4 can be greater than diameter D3. Accordingly, in the locked position 540, a greater radially inward force is applied to the flexible upper linkage rod 509.

Assuming the lift rod 106 is placed inside of the flexible upper linkage rod 509, the flexible upper linkage rod 509 can be placed in the locked position 540 (FIG. 5A). In the locked position 540, the lift rod 106 is securely attached to the flexible upper linkage rod 509. In this example, the lift rod 106 can now be used to control the drain stopper because it is securely attached to the flexible linkage assembly 503.

Figure 5F:
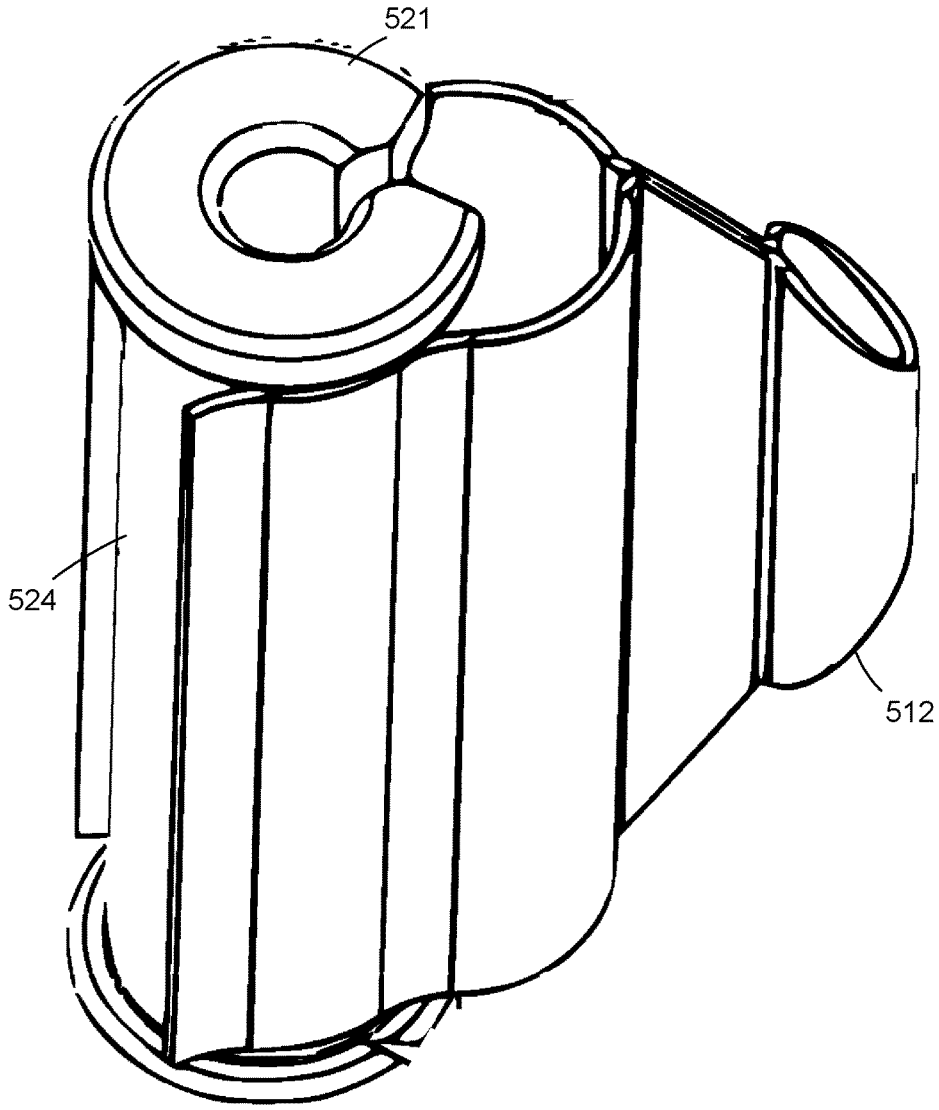

The installed position 543 can be used for attaching the retaining clip 512 to the flexible upper linkage rod 509, but not as firmly as in the locked position 540. The installed position 543 may be used when the flexible linkage assembly is pre-assembled and placed in item packaging. FIG. 5F illustrates the retaining clip 512 being used in the installed position 543.

Figure 5G:
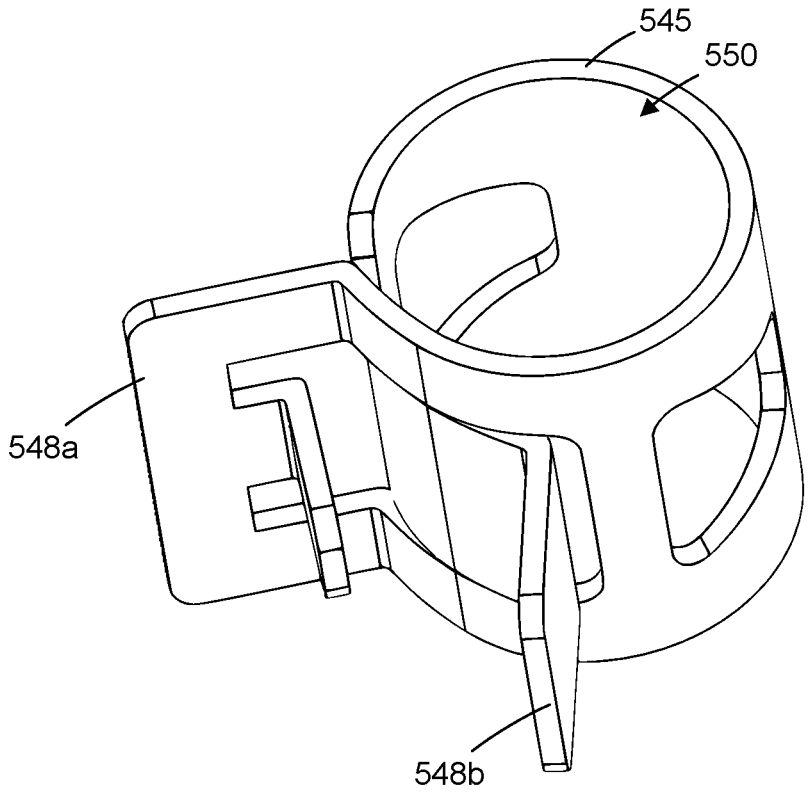
FIG. 5G illustrates a perspective view of an alternative retaining clip, according to one embodiment described herein.

Turning to FIG. 5G, shown is an alternative retaining clip 545 for securing the lift rod 106 to the flexible upper linkage rod 509. The alternative retaining clip 545 comprises a first tab clip 548*a* and a second tab clip 548*b* (collectively "tab clips 548") that are used to expand and contract a diameter of an interior opening 550 of the alternative retaining clip 545. In one scenario, the tab clips 548 can be pressed toward each other, which increases the diameter of the interior opening 550. The second end of the flexible upper linkage rod 509 can be inserted through the interior opening 550 of the alternative retaining clip 545, and the alternative retaining clip 545 can be positioned on the recessed retaining slot 524. The tab clips 548 can be released, which in turn causes the diameter of the interior opening 550 to decrease and apply a radially inward force to the recessed retaining slot 524. The radially inward force causes the width of the linkage slot 518 to contract. The decreased width of the linkage slot 518 decreases the amount of space in the interior of the flexible upper linkage rod 509, and it decreases the interior diameter of the flexible upper linkage rod 509. Assuming the lift rod 106 is inserted in the interior of the flexible upper linkage rod 509, the force applied by the alternative retaining clip 545 can facilitate securing the lift rod 106 to the flexible upper linkage rod 509. Now, the lift rod 106 can be used to operate a drain stopper because of the attachment between the lift rod 106 and the flexible linkage assembly 503. As one skilled in the art can appreciate, other sorts of retaining clips can be used such as hose clamps and other suitable clamps.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An apparatus for a pop-up drain linkage, comprising:

a spring clip formed from a material capable of elastic deformation, the spring clip comprising a first end aperture, a second end aperture, and a connector aperture separated between a number of bending lines positioned along a length of the spring clip, wherein the spring clip can be elastically deformed for insertion of a lift rod through the first end aperture and the second end aperture;

an upper linkage rod that extends in a direction longitudinally and comprises a socket at a first end and a snap-on connector at a second end; and a lower linkage rod comprising a ball disposed toward an end of the lower linkage rod and a slot that extends along a length of the lower linkage rod, the slot being used for connecting with a ball rod of a pop-up drain body.

2. The apparatus of claim 1, wherein the ball extends perpendicular from the length of the lower linkage rod.

3. The apparatus of claim 1, wherein the socket comprises a first side and a second side, wherein the first side of the socket comprises a first perimeter opening distance that is greater than a second perimeter opening distance of the second side.

4. The apparatus of claim 3, wherein the second side of the socket comprises a U-shape.

5. The apparatus of claim 1, wherein the snap-on connector comprises a slot that separates a first lip and a second lip, wherein the first lip and the second lip can be moved toward each other when inserting the spring clip.

6. The apparatus of claim 5, wherein the first lip and the second lip form at least one of a circular slot, an oval slot, or a rectilinear slot for retaining the spring clip.

7. The apparatus of claim 1, wherein the ball comprises a first material and the lower linkage rod comprises a second material.

8. The apparatus of claim 1, wherein the upper linkage rod comprises an elongated cross-shape.

9. A lavatory pop-up drain linkage assembly, comprising:

a socket;

an upper linkage rod that extends in a direction longitudinally and is attached to the socket at a first end, the upper linkage rod comprising an opening at a second end and a linkage slot that extends from the second end, wherein a lift rod of a faucet can be inserted into the opening;

a retaining clip that is positioned around at least a portion of the second end of the upper linkage rod in order to attach the lift rod to the upper linkage rod; and a lower linkage rod comprises a ball disposed toward an end of the lower linkage rod and a slot that extends along a length of the lower linkage rod, the ball of the lower linkage rod being positioned within the socket, the slot being used for connecting with a ball rod of a pop-up drain body.

10. The lavatory pop-up drain linkage assembly of claim 9, wherein the slot of the lower linkage rod extends from a first end of the lower linkage rod to a second end of the lower linkage rod.

11. The lavatory pop-up drain linkage assembly of claim 9, wherein the lower linkage rod comprises a stand that extends perpendicular from the lower linkage rod and connects to the ball.

12. The lavatory pop-up drain linkage assembly of claim 9, wherein the socket comprises a first tab and a second tab that are used to secure the socket at the first end of the upper linkage rod.

13. The lavatory pop-up drain linkage assembly of claim 12, wherein the upper linkage rod comprises a first tab aperture and a second tab aperture proximate to the first end of the upper linkage rod, wherein the first tab and the second tab of the socket snap into the first tab aperture and the second tab aperture.

14. The lavatory pop-up drain linkage assembly of claim 9, wherein the second end of the upper linkage rod comprises a recessed retaining slot for the retaining clip.

15. The lavatory pop-up drain linkage assembly of claim 9, wherein the retaining clip comprises an installed position and a locked position, wherein the locked position has a smaller diameter than at the installed position.

16. A method of assembling a lavatory drain pop-up linkage, comprising:

inserting a ball of a lower linkage rod into a socket end of an upper linkage rod, the ball extending from a first end of the lower linkage rod, the lower linkage rod having a slot that extends a length of the lower linkage rod;

inserting a snap-on connector of the upper linkage rod through a first aperture of a spring clip, the spring clip having the first aperture between a second aperture and a third aperture;

moving the second aperture and the third aperture of the spring clip toward each other;

inserting an end of a lift rod through the second aperture and the third aperture; and inserting an end of a ball rod into a second end of the lower linkage rod.

17. The method of claim 16, wherein the insertion of the end of the ball rod further comprises aligning a raised edge of the ball rod with the slot of the lower linkage rod.

18. The method of claim 17, wherein a cylindrical portion of the ball rod is positioned in an interior of the lower linkage rod.

19. The method of claim 16, wherein the insertion of the snap-on connector of the upper linkage rod through the first aperture of the spring clip further comprises moving a first lip and a second lip of the snap-on connector toward each other.

20. The method of claim 19, wherein the first lip and the second lip of the snap-on connector form a circular slot for restraining the spring clip.

* * * * *